US006095047A

United States Patent [19]

Dawley

[11] Patent Number: 6,095,047

[45] Date of Patent: Aug. 1, 2000

[54] WEB-FED ROTARY PRINTING PRESS WITH APPARATUS FOR DIVERTING A WET PRINTED WEB

[75] Inventor: David Robert Dawley, Rochester, N.H.

[73] Assignee: Heidelberger Drukmaschinen AG, Heidelberg, Germany

[21] Appl. No.: 09/114,544

[22] Filed: Jul. 13, 1998

[51] Int. Cl.[7] ..... B41F 1/28

[52] U.S. Cl. ..... 101/417; 101/416.1; 101/181

[58] Field of Search ..... 101/416.1, 417, 101/422, 424, 181; 156/98

[56] References Cited

U.S. PATENT DOCUMENTS

| | | | |
|---|---|---|---|
| 902,165 | 10/1908 | Pancoast | 101/422 |
| 1,970,929 | 8/1934 | Wood | 101/181 |
| 2,329,152 | 7/1943 | Breyer | 101/422 |
| 3,937,141 | 2/1976 | Dahlgren | 101/148 |
| 5,651,316 | 7/1997 | DeMoore et al. | 101/450 |

*Primary Examiner*—John S. Hilten
*Assistant Examiner*—Charles H. Nolan, Jr.
*Attorney, Agent, or Firm*—Kenyon & Kenyon

[57] ABSTRACT

A lithographic web-fed rotary printing press (1) comprises an apparatus (8*a*, 8*b*, 8*c*, 8*d*) for diverting a wet printed web (4), e.g. in order to pass it around a downstream printing unit (2*b*) of the press (1). Each diverting apparatus (8*a*, 8*b*, 8*c*, 8*d*) includes a diverting roll (12) having a hydrophilic surface, to which water solution 14, preferably dampening solution, as it is used in dampening systems of a lithographic rotary printing press, is supplied by a spray nozzle arrangement (22), or by an applicator roller (16) which is in contact with a pan roller (20) for transferring the water solution (14) from a reservoir (18).

19 Claims, 1 Drawing Sheet

WEB-FED ROTARY PRINTING PRESS WITH APPARATUS FOR DIVERTING A WET PRINTED WEB

FIELD OF THE INVENTION

The present invention relates to an apparatus for diverting a wet printed web in web-fed rotary printing presses.

RELATED TECHNOLOGY

In web-fed rotary printing presses, a running paper web is fed through one or more printing units to apply a single or a multicolour image on one or on both sides of the web.

Afterwards the wet printed web is fed to a dryer for drying the wet ink and afterwards fed to a subsequent folder section in which the printed web is folded and cut into signatures. However, in printing presses having a plurality of printing units for printing multicolor images to the web, it may be desired for certain print jobs to only print one color to the web. In such cases, it is known to divert the web around the printing units which are not needed for a specific print job, rather than passing the web through the printing units which usually results in a smearing of the freshly printed image. For diverting the web around the inactive printing units, it is known to pass the web over lead rolls which are located above the printing units to be bypassed.

In printing presses, in which the printing units are arranged one above the other in tower arrangements, and in which the web is running substantially vertically through the printing units of a tower arrangement, lead rolls are used to deflect the web when running from one printing unit to another, in order to obtain a certain wrap of the web around the cylinders of the units, or are used to guide the web from one tower arrangement to another tower arrangement.

The known lead rolls, however, show the deficiency that although their surface is usually coated with chromium, ink is transferred from the web to the chromium surface of the lead rolls, resulting in a build up of ink on the surface which causes a smearing of the printed image.

SUMMARY OF THE INVENTION

It is an object of the present invention to provide for an apparatus for diverting a wet printed web in a web-fed rotary printing press, in particular in a lithographic offset printing press, which avoids smearing of the freshly printed image when diverting the web before passing it through a dryer of the printing press.

The present invention therefore provides an apparatus for diverting a wet printed web in a web-fed rotary printing press comprising a diverting roll over which the wet printed web is passed and further comprises a water solution applicator for directly applying a water solution to the diverting roll. The water solution is preferably dampening liquid or dampening solution which is used in a dampening unit of a lithographic printing press.

The diverting roll advantageously may have a hydrophilic surface, as e.g. chromium.

The water solution applicator may comprise a water solution applicator roll which contacts the diverting roll. The water solution applicator roll advantageously is a rubber coated roll which is in contact with a further pan roll which receives water solution from a water solution reservoir and transfers it to the water solution applicator roll.

According to another embodiment of the invention, the water solution applicator comprises a spray nozzle arrangement which sprays the water solution directly onto the diverting roll.

BRIEF DESCRIPTION OF THE DRAWINGS

The present invention, together with additional objects and advantages thereof, will be best understood from the following description of specific exemplary embodiments when read in connection with the accompanying drawing, in which.

DETAILED DESCRIPTION

Figure 1:
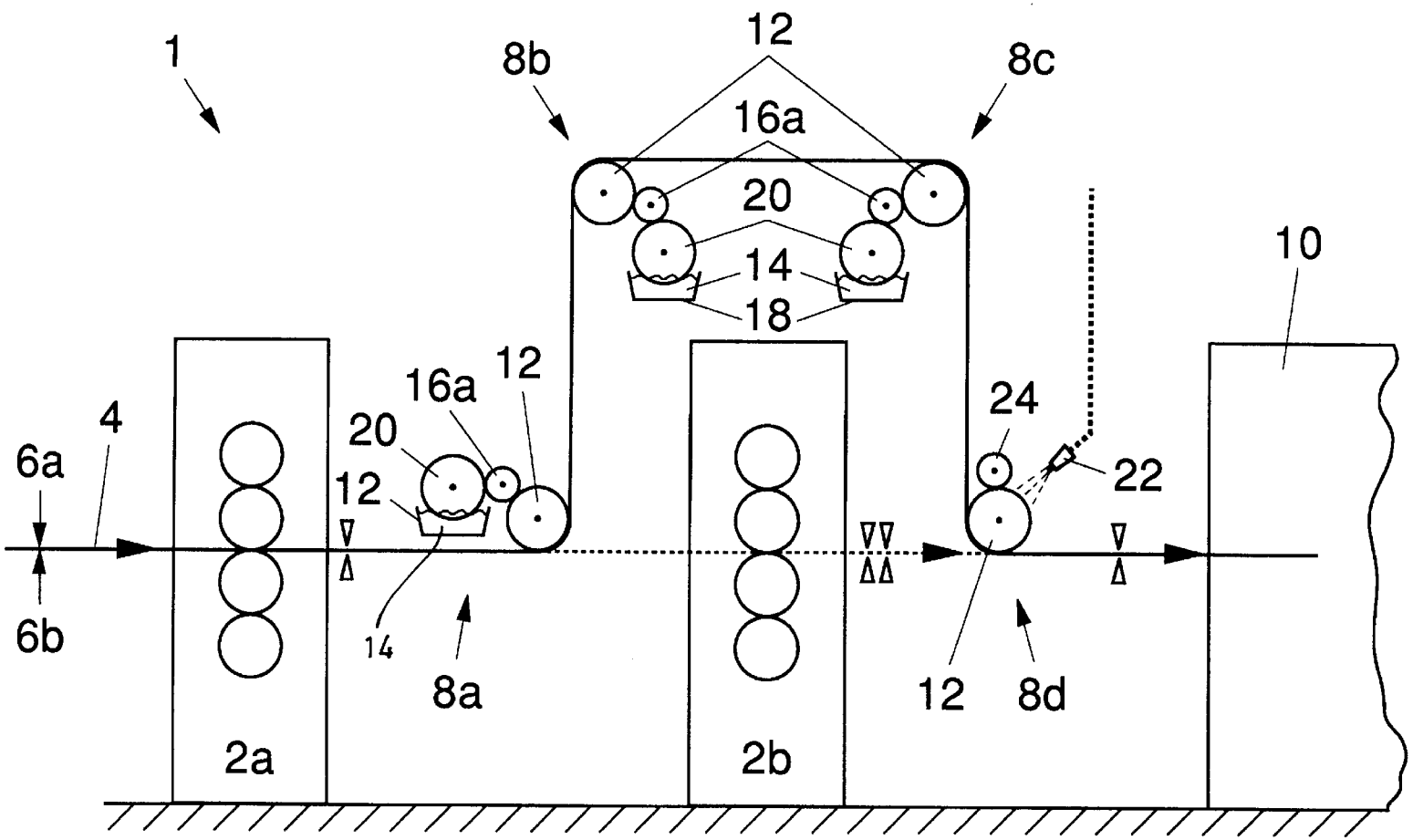
FIG. 1 is a schematic view of a lithographic web-fed rotary printing press with two printing units, in which the web is diverted around the second printing unit by lead rolls according to the present invention before the web enters the dryer.

As shown in FIG. 1. a lithographic web-fed rotary printing press 1 comprises a plurality of printing units 2, e.g. two printing units 2*a*, 2*b* through which a web 4 is passed to be printed with a single or a multicolor image on a first, upper side 6*a* and on a second, lower side 6*b*. After being printed with a first color in the first printing unit 2*a*, the wet printed web is either directly transferred to the second downstream printing unit 2*b* (as indicated in dotted lines) if it is desired to print a second color to the respective sides 6*a*, 6*b* of the web 4 or is diverted around the second downstream printing unit 2*b*, as it is indicated by full lines in FIG. 1, if it is desired not to print a further color on the web 4 in printing unit 2*b*.

For passing the web 4 around the second downstream printing unit 2*a*, a first diverting apparatus 8*a* is located between the first printing unit 2*a* and the second printing unit 2*b*. The wet web 4 which was printed in the first printing unit 2*a* is passed over the first diverting apparatus 8*a* and diverted such that it is moving substantially in a vertical direction. A second diverting apparatus 8*b* for diverting the web 4 in a substantially horizontal direction, a third diverting apparatus 8*c* for diverting the web 4 in the downward direction, and a fourth diverting apparatus 8*d* for diverting the web 4 towards a subsequent dryer 10 of the printing press 1 are located around the upper part of the second downstream printing unit 2*b*, as it is shown in FIG. 1.

Each of the diverting apparatuses 8*a*, 8*b*, 8*c*, 8*d* comprises a diverting roll 12 over which the wet printed web 4 is passed. The diverting roll 12 preferably has a hydrophilic surface and may be made of chromium or another suitable hydrophilic material.

As it can be seen from FIG. 1. a water solution 14, preferably conventional dampening solution, as used in dampening systems of lithographic rotary printing presses, is applied to the diverting rolls 12 using a water solution applicator 16. According to a first embodiment of the present invention, the water solution applicators are in the form of applicator rolls 16*a*, preferably rubber rolls, which are in contact with the diverting roils 12, as it is shown for the first, second, and third diverting apparatuses 8*a*, 8*b*, and 8*c* of FIG. 1. In this embodiment of the present invention, the water solution 14 is contained in a water solution reservoir 18 from where it is transferred to the water solution applicator roll 16*a* by a pan roller 20 which is partially immersed into the water solution 14. The diverting roll 12 is preferably driven by a motor (not shown) with a speed substantially equal to the speed of the paper web 4, although it may also be possible that the diverting roll 12 is a non-driven roll which is driven by the frictional forces between the web 4 and the surface of the roll 12 or by the applicator roll 16*a* contacting the surface of the diverting roll 12. Alternatively, it is also possible to drive both rolls 12 and 16*a* and moreover the pan roll 20 via separate motors or via an adjustable gear (not shown), in order to obtain a speed difference between the surface speeds of two of the rollers and thereby adjust the amount of water solution 14 transferred to the web 4. Another possibility to adjust the amount of water solution 14 is to alter the contact pressure between the pan roll 20 and the applicator roll 16*a* or between the applicator roll 16*a* and the diverting roll 12.

According to another embodiment of the present invention, the water solution 14 is directly applied to the diverting roll 12 using a spray nozzle arrangement 22, as it is schematically shown for the fourth diverting apparatus 8*d*. In this embodiment of the present invention, there may be provided a further distributing roll 24, preferably a driven rubber roller, for evenly distributing the water solution 14 sprayed onto the surface of the diverting roller 12 by the spray nozzle arrangement 22.

It will be appreciated by those skilled in the art that the present invention can be embodied in other specific forms without departing from the spirit or essential characteristics thereof. In particular, the diverting apparati 8*a*, 8*b*, 8*c*, and 8*d* advantageously may comprise five rolls between the water solution and the web.

The presently disclosed embodiments are therefore considered in all respects to be illustrative and non-restrictive. The scope of the invention is indicated by the appended claims rather then the foregoing description and all changes that come within the meaning and range and equivalence thereof are intended to be embraced therein.

What is claimed is:

1. A web-fed lithographic rotary printing press comprising:

a lithographic offset printing unit for printing a web so as to form a wet printed web:

a diverting roll over which the wet printed web is passed for circumventing a printing unit; and a lithographic dampening solution applicator for directly applying a lithographic dampening solution to the diverting roll.

2. The printing press as recited in claim 1 wherein the diverting roll has a hydrophilic surface.

3. The printing press as recited in claim 2 wherein the hydrophilic surface is chromium.

4. The printing press as recited in claim 1 wherein the lithographic dampening solution applicator includes a lithographic dampening solution applicator roll contacting the diverting roll.

5. The printing press as recited in claim 4 wherein the lithographic dampening solution applicator further includes a lithographic dampening solution reservoir and a pan roll receiving lithographic dampening solution from the lithographic dampening solution reservoir and transferring the lithographic dampening solution to the lithographic dampening solution applicator roll.

6. The printing press as recited in claim 1 wherein the lithographic dampening solution applicator includes a spray nozzle arrangement for spraying the lithographic dampening solution onto the diverting roll.

7. The apparatus as recited in claim 1 wherein the diverting roll is located between a last printing unit of the web-fed rotary printing press and a dryer of said printing press.

8. The apparatus as recited in claim 1 wherein the diverting roll is located between a first and a second printing unit of the web-fed rotary printing press.

9. The printing press as recited in claim 1 further comprising a second diverting roll over which the wet printed web is passed and a second lithographic dampening solution applicator for directly applying a lithographic dampening solution to the second diverting roll.

10. A web-fed rotary printing press comprising:

a first printing unit for printing a first color on a web;

a second printing unit for printing a second color on the web;

a dryer for drying the web after printing;

a diverting roll over which the web is passed before drying in the dryer, the diverting roll diverting the web to bypass the second printing unit; and a water solution applicator for directly applying a water solution to the diverting roll.

11. The printing press as recited in claim 10 wherein the diverting roll has a hydrophilic surface.

12. The printing press as recited in claim 11 wherein the hydrophilic surface is chromium.

13. The printing press as recited in claim 10 wherein the water solution applicator includes a water solution applicator roll contacting the diverting roll.

14. The printing press as recited in claim 13 wherein the water solution applicator further includes a water solution reservoir and a pan roll receiving water solution from the water solution reservoir and transferring the water solution to the water solution applicator roll.

15. The printing press as recited in claim 10 wherein the water solution applicator includes a spray nozzle arrangement for spraying the water solution onto the diverting roll.

16. The printing press as recited in claim 10 wherein the water solution is a lithographic dampening fluid.

17. The printing press as recited in claim 10 wherein the diverting roll is located between the second printing unit and the dryer.

18. The printing press as recited in claim 10 wherein the diverting roll is located between the first and the second printing unit.

19. The printing press as recited in claim 10 further comprising a second diverting roll over which the web is passed before drying in the dryer and a second water solution applicator for directly applying a water solution to the second diverting roll.

* * * * *